US006668883B2

(12) United States Patent
Buechele

(10) Patent No.: US 6,668,883 B2
(45) Date of Patent: Dec. 30, 2003

(54) POUCH-LIKE CONTAINER IN PARTICULAR BILLFOLD AND THE LIKE

(75) Inventor: Eugen Buechele, Kirchberg/Iller (DE)

(73) Assignee: Esquire-Lederwaren Rupp & Ricker GmbH, Rodgau (DE)

( * ) Notice: Subject to any disclaimer, the term of this patent is extended or adjusted under 35 U.S.C. 154(b) by 0 days.

(21) Appl. No.: 09/812,256

(22) Filed: Mar. 19, 2001

(65) Prior Publication Data

US 2001/0025678 A1 Oct. 4, 2001

(30) Foreign Application Priority Data

Apr. 4, 2000 (DE) ..... 200 06 182 U
Dec. 15, 2000 (DE) ..... 100 62 808

(51) Int. Cl.[7] ..... A45C 1/06
(52) U.S. Cl. ..... 150/131; 150/147; 206/425
(58) Field of Search ..... 150/131, 132, 150/136, 138, 139, 147, 146, 134; 206/925; 40/124.2, 124.01, 124.06

(56) References Cited

U.S. PATENT DOCUMENTS 3,483,909 A 12/1969 Osher et al.
3,565,148 A * 2/1971 Miller ..... 150/147
4,004,690 A * 1/1977 Giarritta ..... 206/425
4,716,948 A 1/1988 Brissette
4,832,372 A * 5/1989 Young ..... 150/139
4,890,728 A 1/1990 Grimsley
4,921,027 A * 5/1990 Scheunemann ..... 150/146
5,431,207 A * 7/1995 Siegel ..... 150/139
5,662,219 A * 9/1997 Tschudy et al. ..... 150/113

* cited by examiner

*Primary Examiner*—Stephen K. Cronin
*Assistant Examiner*—Lien Ngo
(74) *Attorney, Agent, or Firm*—W. F. Fasse; W. G. Fasse

(57) ABSTRACT

A billfold, pocketbook, wallet or the like, has insertion compartments that are arranged in a staggered partially overlapping manner one above the other, and that are intended for receiving credit cards and the like through an insertion and removal opening of the respective compartment. The direction for pushing cards into and removing cards from the insertion compartments is transverse to the main axis of the staggering of the compartments and preferably is oriented inwardly perpendicular to a folding axis of the wallet. The credit cards are thereby prevented from inadvertently falling out of the compartments.

20 Claims, 4 Drawing Sheets

POUCH-LIKE CONTAINER IN PARTICULAR BILLFOLD AND THE LIKE

FIELD OF THE INVENTION

The invention relates to a pouch-like container, in particular in the form of a billfold, pocketbook and the like, having insertion compartments which are arranged in a staggered, shingled or graduated manner one above the other and each have at least one insertion opening adapted, in particular, to credit cards and the like.

BACKGROUND INFORMATION

Wallets, billfolds and pocketbooks of the type mentioned are known in various forms and basically also fulfill their purpose to a satisfactory extent. In particular for credit cards and/or plastic cards, these pouch-like containers have insertion compartments which are arranged in a flat state one upon the other and in a staggered manner. The object of the invention is to improve the functions of these insertion compartments.

SUMMARY OF THE INVENTION

In order to achieve the above mentioned object, the invention provides that the direction for pushing the cards into the insertion compartments and the direction of the main axis of the staggering are arranged transversely to one another.

In the case of the known containers or pouches of the type in question here, the insertion direction and the staggering direction coincide with one another. This means, in practice, that the insertion compartments are open in the direction of a free border of the pouch-like container, with the result that, in principle, there is a risk of cards being able to drop out of the insertion compartments. This applies, in particular, when the insertion compartments have a relatively large amount of clearance. In order that the cards do not drop out of the insertion compartments, the latter are usually very narrow and adapted directly to the format of the cards. This means that only a single card in each case fits into an insertion compartment. Nowadays, however, it is frequently the case that users of credit cards and other plastic cards require not just one or two cards, but often a dozen cards, with the result that it is correspondingly necessary for a number of cards to be accommodated in a pouch-like container of the type in question here. This is also possible in a space-saving manner if not just a single card, but two or three cards, can be arranged in an insertion compartment, it nevertheless being ensured that a card cannot be lost even when only a single card is located in the insertion compartment intended for more than one card. This safety aspect is achieved if, according to the invention, the staggering direction and the insertion direction are not the same, as has been the case hitherto, with the result that the insertion openings are open, for example, toward the pouch interior or toward a folding axis of a pouch comprising, for example, two halves. The position of the insertion opening provides an additional safeguard against loss of the article located in the insertion compartment, it being possible for said article to be a credit card and/or plastic card or also, in the broadest sense, some other document or paper.

The invention, however, is not restricted to this particularly expedient method of arranging the insertion openings.

BRIEF DESCRIPTION OF THE DRAWINGS

The invention is described in more detail hereinbelow with reference to exemplary embodiments which are illustrated in the drawing, in which.

DETAILED DESCRIPTION OF THE INVENTION

Figure 1:
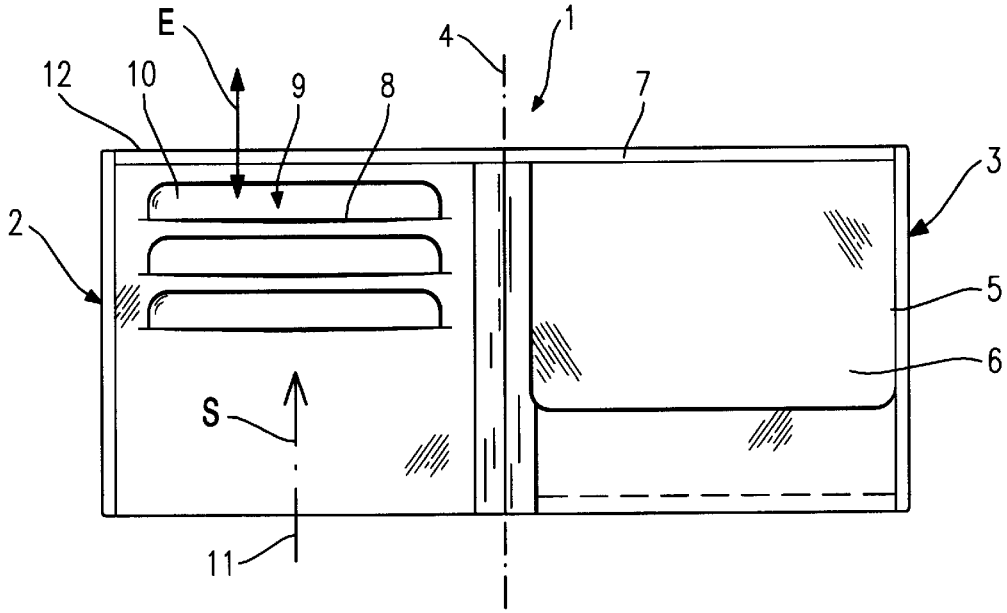
Fig. 1 PRIOR ART
FIG. 1 shows a view of a conventional wallet with a bill compartment and with insertion compartments for credit cards or other plastic cards.

According to the prior art, a pouch-like container 1 in the form of a basically known wallet according to FIG. 1 comprises two container halves 2 and 3 which are connected to one another along a common folding axis 4. This container 1 has a coin compartment 5 with a cover 6 and a bill compartment 7 which extends over both container halves 2 and 3. Moreover, a plurality of insertion compartments 9, each having an insertion opening 8, are provided for credit cards 10 and/or for plastic cards or the like. These insertion compartments 9 are arranged in a staggered manner one above the other, with the insertion direction (double arrow E) for pushing the credit cards 10 and/or plastic cards into the insertion openings 8 corresponding to the staggering direction of the main axis 11 for the staggering (arrow S).

As FIG. 1 also shows, all the insertion compartments 9 are open toward a border 12 of the container 1. This means that, in principle, a credit card 10 and/or plastic card can drop out of an insertion compartment 9 if the insertion opening 8 is of generous dimensions.

Figure 2:
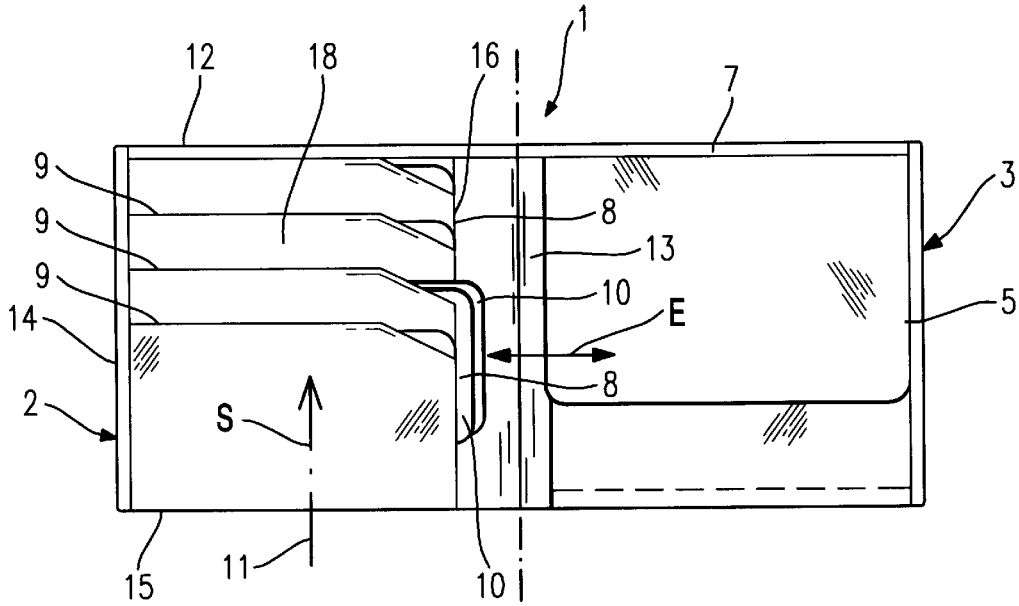
FIG. 2 shows a view as in FIG. 1, but of a wallet according to the invention with insertion compartments open transversely to the direction of graduation or staggering thereof.

FIG. 2 shows basically the same type of container 1, likewise in the form of a wallet with a coin compartment 5, bill compartment 7 and insertion compartments or pockets 9 for credit cards 10 and/or for plastic cards, but arranged according to the invention. Here too, the insertion compartments 9 are arranged in a graduated or staggered manner one above the other, the main axis 11 of the staggering (arrow S) being in the same direction as in the case of the conventional wallet illustrated in FIG. 1. However, the insertion openings 8 of the insertion compartments 9, rather than being opened toward the border 12 of the container 1 as in conventional FIG. 1, are opened in the insertion direction E toward the interior 13 or the folding axis 4 of the container 1, and thus perpendicularly to the staggering direction S in the inventive arrangement shown in FIG. 2.

All the insertion compartments 9 in the container 1 are closed toward the respectively adjacent borders 12, 14 and 15. It is thus not possible for credit cards 10 and/or plastic cards to drop out of a container 1 or out of a wallet when the two container halves 2 and 3 are located one upon the other, as is usually the case in the closed state.

Finally, it is particularly advantageous for it also to be possible for more than one credit card 10 to be arranged in an insertion compartment 9 in each case. This is illustrated by way of example in FIG. 2.

The essential difference between the two containers 1 according to FIGS. 1 and 2 resides in the fact that the push-in and removal direction E for the credit cards and the direction of the staggering S are the same in the case of the known container 1, whereas they are arranged transversely to one another in the case of the container 1 according to the invention. The push-in and removal direction E is thus located perpendicularly to the main axis 11 of the staggering S.

Figure 3:
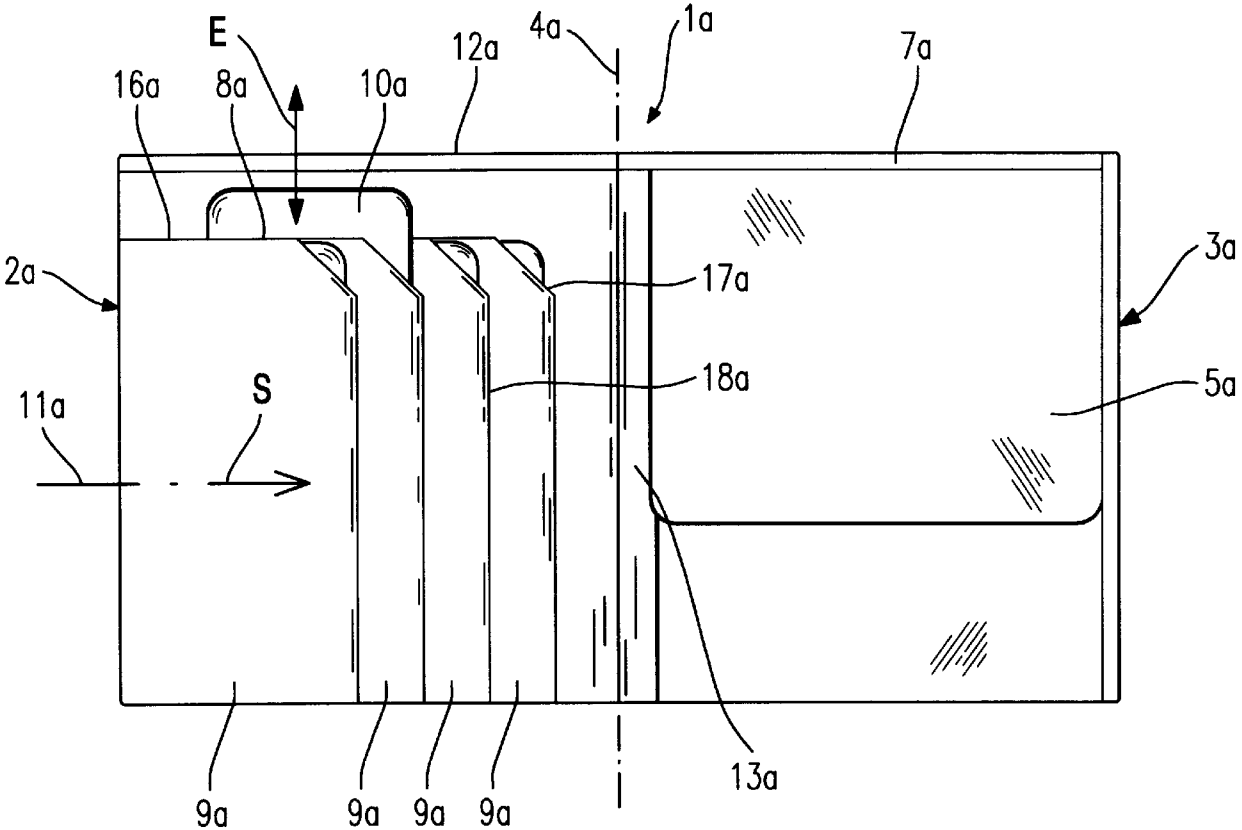
FIG. 3 shows, on an enlarged scale, a view as in FIG. 2 of a modified wallet with a bill compartment and with an insertion-compartment graduation or staggering arranged transversely to the insertion direction.

A further container 1*a*—to be precise likewise in the form of a wallet—is illustrated, on a somewhat larger scale, in FIG. 3. Basically the same parts have the same designations and, in addition, the letter index a.

The container 1*a* comprises, in turn, two container halves 2*a* and 3*a* with a coin compartment 5*a,* a bill compartment 7*a* and a plurality of insertion compartments 9*a* for cards equal in size to a credit card 10*a.* It is possible for one or more credit cards 10*a* to be arranged in each insertion compartment 9*a.*

The insertion openings 8*a* of the insertion compartments 9*a* are each located, just as with the first-described container 1 according to FIG. 2, on a narrow border 16 or 16*a* of each insertion compartment 9 or 9*a,* respectively. In accordance with the exemplary embodiment illustrated in FIG. 3, the insertion compartments 9*a* are opened toward the border 12*a* of the container 1*a,* as can also be gathered from FIG. 3 with reference to the double arrow for the insertion and removal direction E. The insertion and removal direction E is located, in turn, perpendicularly or transversely to the staggering S of the insertion compartments 9*a.*

In the exemplary embodiment illustrated in FIG. 3, the main axis 11*a* of the staggering S of the insertion compartments 9*a* is arranged perpendicularly to the folding axis 4*a,* about which the two container halves 2*a* and 3*a* can be folded one upon the other.

The insertion openings 8*a* of the insertion compartments 9*a* are arranged such that they are directed neither toward the folding axis 4*a* nor toward the pouch interior 13*a,* whereas the staggering S in accordance with the main axis 11*a* for the insertion compartments 9*a* arranged in a staggered manner is directed toward the folding axis 4*a* and pocket interior 13*a.*

It may also be gathered from the exemplary embodiment illustrated in FIG. 3 that the border 16*a* of at least one insertion opening 8*a* is angled at at least one end 17*a.*

With both containers 1 and 1*a,* the insertion compartments 9, 9*a* are staggered via the long sides 18 and 18*a,* respectively. Correspondingly, the insertion openings 8, 8*a* are located on the narrow sides 16, 16*a.* Even if not illustrated in the figures, it nevertheless goes without saying that it is also possible for the insertion compartments to be graduated via the narrow sides and to have the insertion openings on their long sides.

Figure 4:
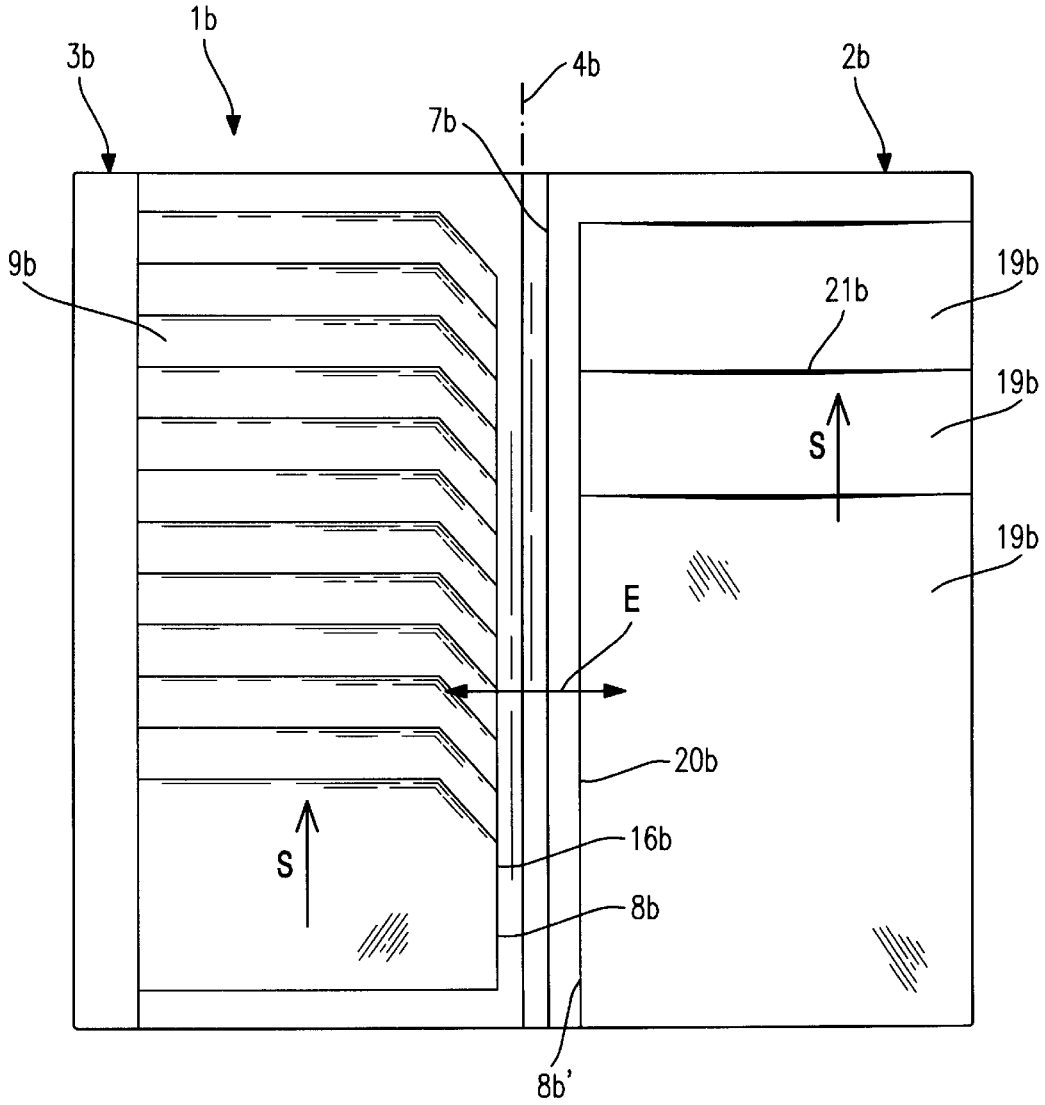
FIG. 4 shows a view of a pocketbook with the insertion direction for credit cards and/or plastic cards arranged transversely to the graduation or staggering of the compartments and with the insertion direction for an identity card, driver's license and the like arranged transversely to the graduation or staggering of the compartments, and with a bill compartment.

A further exemplary embodiment of a container 1*b,* which may be a pocketbook, is illustrated in FIG. 4. Basically the same parts, again, have the same designations and, in addition, the letter index b.

The container 1*b* is provided with a billfold 7*b* and has a container half 2*b* with insertion compartments 19*b* for identity papers and the like on its inside. These insertion compartments 19*b* may be intended, in particular, for small-format identity papers. Insertion compartments 9*b* for cards 10*b* of credit card format are provided on the inside of the other container half 3*b.* These insertion compartments 9*b* are arranged in a staggered manner in the direction S, whereas the openings 8*b* for the insertion compartments 9*b,* corresponding to the push-in and removal direction E in FIG. 4, are arranged transversely thereto. The short or narrow borders 16*b* of the insertion compartments 9*b* are located parallel to the folding axis 4*b* of the container 1*b,* it being possible for the two container halves 2*b* and 3*b* to be folded one upon the other about this folding axis 4*b.* The insertion and removal openings 8*b*' of the insertion compartments 19*b* are likewise located parallel to the folding axis 4*b.* The removal openings 8*b*' are each located in long sides 20*b* of the insertion compartments 19*b.* The insertion compartments 19*b* are staggered via the respectively short or narrow sides 21*b* in accordance with the arrow S in FIG. 4.

In the state in which the two container halves 2*b* and 3*b* have been folded one upon the other, that is to say in the closed state of the same, the contents of all the insertion compartments 9*b* and 19*b* are secured against dropping out in each case.

Figure 5:
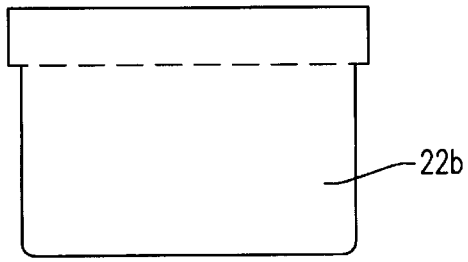
FIG. 5 shows a view of a coin holder as a handling unit, additionally for use with a pocketbook according to FIG. 4.

Finally it is expedient if a pocketbook in accordance with the container 1*b* contains an additional holder 22*b* as a separate handling unit exclusively for coins according to FIG. 5.

Figure 6:
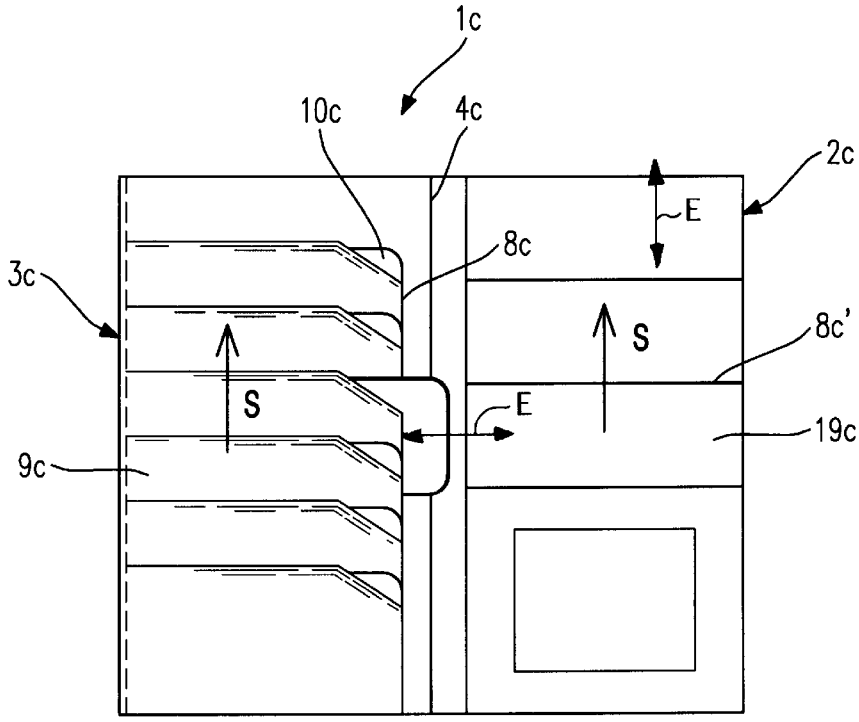
FIG. 6 shows, on a different scale, a view of the inside of another pocketbook comprising two halves.
Figure 7:
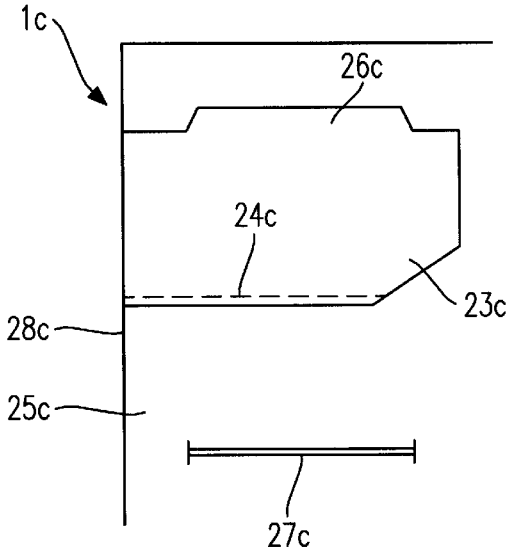
FIG. 7 shows, on an enlarged scale, an illustration of essential parts during the production of an insertion compartment for the pocketbook of FIG. 6.
Figure 8:
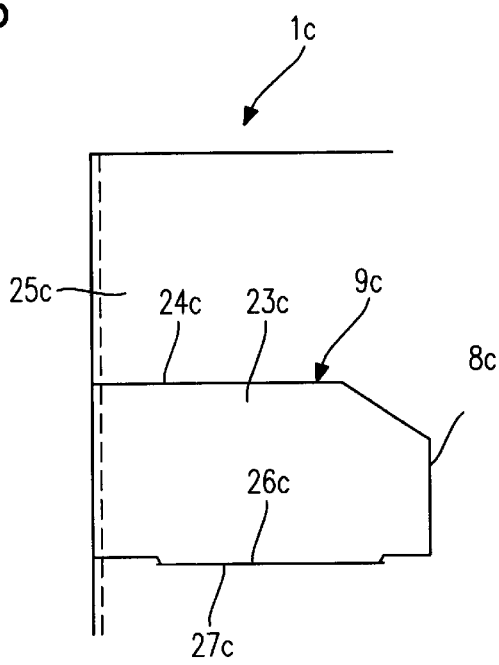
FIG. 8 shows a schematic diagram as in FIG. 7 once the insertion compartment has been produced.

A further container 1*c* can be gathered from FIG. 6, and details relating to the production of the container 1*c* are illustrated in FIGS. 7 and 8.

The container 1*c,* in turn, has two container halves 2*c* and 3*c* which can be folded one upon the other about a folding axis 4*c* and which each bear insertion compartments 9*c* and 19*c* on the inside. The insertion compartments 9*c* and 19*c* are staggered in a direction S parallel to the folding axis 4*c.* The insertion openings 8*c* for credit cards 10*c,* on the one hand, and the insertion openings 8*c*' of the large insertion compartments 19*c* on the other hand, are respectively opened in different directions in accordance with the double arrows E. The insertion openings 8*c* for the credit cards 10*c* are thus located parallel to the folding axis 4*c* and therefore transversely to the staggering S, whereas the insertion openings 8*c*' are opened in the direction of the staggering S. The insertion compartments 9*c* for the credit cards 10*c,* in turn, are closed on both long sides and on one short or narrow side, and are open in each case only on one short or narrow side, which is directed toward the folding axis 4*c* of the container 1*c.* The steps illustrated in FIGS. 7 and 8 may be used in order to produce such a staggered arrangement of the compartments.

As shown in FIG. 7 in a first step, a respectively top compartment wall 23*c* is sewn along its top border 24*c* to a base 25*c* and has a flap 26*c* which is to be inserted into a slit 27*c* and adhesively bonded there. In the sewn-on and adhesively bonded state in the following step as shown in FIG. 8, the compartment wall 23*c,* also connected to the border 28*c* of the base 25*c,* forms an insertion compartment 9*c* with an insertion opening 8*c.*

It goes without saying, however, that the production of the containers 1 according to FIG. 2 to 1*c* according to FIG. 6 is not restricted to the measures described above.

Finally, it is expedient if a container 1*b* in the form of a pocketbook has a small pocketbook format or is adapted to the size of a back pocket of men's trousers.

What is claimed is:

1. A wallet for storing at least currency notes and credit cards, comprising:

a wallet body including a first body portion and a second body portion foldably joined to each other along a folding axis, allowing said first and second body portions to be selectively folded closed and opened relative to each other about said folding axis;

a currency note compartment that is dimensioned to receive currency notes therein, that extends longitudinally along said first body portion and said second body portion across said folding axis, and that is open along an open longitudinal edge thereof running along a folded side edge of said first and second body portions so as to allow insertion and removal of currency notes through said open longitudinal edge; and a plurality of card compartments that each respectively have the same size dimensioned to receive at least one credit card therein, and that are arranged on a surface of said first body portion facing said second body portion when said first and second body portions are folded closed relative to each other about said folding axis;

wherein:

said card compartments each respectively comprise four sides including a closed fixed side, two mutually opposite closed sides, and an open insertion side opposite said closed fixed side, whereby a credit card may be inserted into and removed from said respective card compartment through said open insertion side in only one card insertion and removal direction parallel to said mutually opposite closed sides;

said closed fixed side of each said card compartment is fixedly secured to said first body portion, and said mutually opposite closed sides of each said card compartment are fixedly secured to at least one of said first body portion and an adjacent one of said card compartments so that said card compartments are fixed relative to one another and relative to said first body portion;

said card compartments are arranged partially overlapping one another and staggered relative to one another in a partially overlapping staggered row of said compartments extending in a staggering direction; and said card insertion and removal direction is oriented transversely relative to said staggering direction.

2. The wallet according to claim 1, wherein said four sides of each one of said card compartments include two relatively longer sides and two relatively shorter sides, and said open insertion side is one of said relatively shorter sides.

3. The wallet according to claim 2, wherein said open insertion side of each one of said card compartments is oriented toward and located adjacent to said folding axis.

4. The wallet according to claim 1, wherein said open insertion side of each one of said card compartments is oriented toward and located adjacent to said folding axis.

5. The wallet according to claim 4, wherein said two mutually opposite closed sides of each one of said card compartments extend perpendicular to said folding axis.

6. The wallet according to claim 1, wherein said four sides of each one of said card compartments include two relatively longer sides and two relatively shorter sides, and said open insertion side is one of said relatively longer sides.

7. The wallet according to claim 1, wherein said card insertion and removal direction is perpendicular to said staggering direction.

8. The wallet according to claim 7, wherein said card insertion and removal direction is perpendicular to said folding axis.

9. The wallet according to claim 1, wherein said closed fixed side and said two mutually opposite closed sides of each said card compartment are entirely closed.

10. The wallet according to claim 1, wherein said open insertion side extends parallel to said folding axis, and each said card compartment further comprises an open oblique edge transitioning obliquely from said open insertion side to one of said mutually opposite closed sides.

11. The wallet according to claim 1, wherein all of said respective open insertion sides of all of said card compartments are simultaneously accessible when said first and second body portions are opened relative to each other about said folding axis.

12. The wallet according to claim 1, further for storing coins, and further comprising a coin compartment that is larger than each one of said card components and is dimensioned to store coins therein, and a cover that selectively opens and closes said coin compartment, wherein said coin compartment is arranged on said second body portion.

13. A container for storing at least one of currency, papers, and objects having a size and a format of a credit card, said container having plural insertion compartments that each respectively have the same size and the same rectangular format adapted to receive therein a respective object having the size and the format of a credit card, wherein:

said insertion compartments are arranged to partially overlap one another and to be respectively staggered in an overlapping row along an overlapping row direction;

said rectangular format of each said insertion compartment has two mutually opposite longer closed sides, one shorter closed side, and one shorter open side opposite said shorter closed side;

each respective one of said insertion compartments respectively has a single opening on said one shorter open side thereof through which the respective object can be pushed into or pulled out of said respective insertion compartment in a single object insertion and removal direction parallel to said two longer closed sides;

each said insertion compartment is fixedly secured relative to an adjacent one of said insertion compartments along said one shorter closed side and said two mutually opposite longer closed sides; and said object insertion and removal direction is oriented transversely relative to said overlapping row direction.

14. The container according to claim 13, wherein said object insertion and removal direction is oriented perpendicularly relative to said overlapping row direction.

15. The container according to claim 13, wherein said container is a foldable container including two container halves hinged to each other along a folding axis, each one of said container halves is respectively bounded along said folding axis and plural free edges, and said openings of said insertion compartments are oriented toward an interior of said container away from said free edges, and toward said folding axis.

16. The container according to claim 13, wherein each one of said openings is bounded by a straight border portion of said shorter open side and an angled border portion of said shorter open side extending obliquely relative to said straight border portion from one end of said straight border portion to one of said two longer closed sides.

17. The container according to claim 13, wherein said container is at least one of a wallet, a billfold, and a pocketbook, and wherein said container further includes at least one of a coin compartment and a currency note compartment.

18. The container according to claim 17, wherein said container is said billfold, said billfold includes first and second billfold halves, said insertion compartments are provided in said first billfold half, said billfold further includes additional compartments provided in said second billfold half, and said additional compartments are larger than said insertion compartments and are adapted to receive papers therein.

19. The container according to claim 13, having an overall size adapted to fit into a back pocket of men's trousers.

20. The container according to claim 13, wherein said shorter open sides of said insertion compartments have borders that are aligned one upon another.

* * * * *